US008419484B2

(12) United States Patent
Kawai et al.

(10) Patent No.: US 8,419,484 B2
(45) Date of Patent: Apr. 16, 2013

(54) PRESS-FIT TERMINAL HAVING A SMALL INSERTION LOAD

(75) Inventors: Shunsuke Kawai, Toyota (JP); Yasuhiro Sone, Toyota (JP)

(73) Assignee: Toyoda Iron Works Co., Ltd., Toyota-shi, Aichi-ken (JP)

( * ) Notice: Subject to any disclaimer, the term of this patent is extended or adjusted under 35 U.S.C. 154(b) by 202 days.

(21) Appl. No.: 13/064,057

(22) Filed: Mar. 3, 2011

(65) Prior Publication Data

US 2011/0217883 A1 Sep. 8, 2011

(30) Foreign Application Priority Data

Mar. 5, 2010 (JP) ..... 2010-048673

(51) Int. Cl.
*H01R 13/40* (2006.01)

(52) U.S. Cl.
USPC ..... 439/733.1; 439/82

(58) Field of Classification Search ..... 439/733.1, 439/751, 82, 572
See application file for complete search history.

(56) References Cited

U.S. PATENT DOCUMENTS 2,814,024 A * 11/1957 Narozny ..... 439/58
2,877,441 A * 3/1959 Narozny ..... 439/857
2,950,458 A * 8/1960 Artz ..... 439/872
4,435,031 A * 3/1984 Black et al. ..... 439/82
2001/0041467 A1* 11/2001 Kikuchi et al. ..... 439/82

FOREIGN PATENT DOCUMENTS

JP 01115070 A * 5/1989
JP 2000-294331 10/2000
JP 2005-174654 6/2006
JP 2011187196 A * 9/2011

* cited by examiner

*Primary Examiner* — Hae Moon Hyeon
(74) *Attorney, Agent, or Firm* — Finnegan, Henderson, Farabow, Garrett & Dunner, LLP

(57) ABSTRACT

A press-fit terminal includes: through-hole contact portions provided at intermediate portions in a terminal protruding direction, both ends of the through-hole contact portions in a widthwise direction being pressed against an inner peripheral surface of a through-hole; distal end side wide portions and proximal end side wide portions provided on both sides of the through-hole contact portions in the terminal protruding direction, and protruding toward both sides in the widthwise direction so as to position a substrate on both sides of the substrate in a thickness direction; width varying portions whose width gradually reduces from the distal end side wide portions toward a distal end side in the terminal protruding direction; a longitudinal perforated hole provided to extend over these portions; and a distal end connecting portion integrally connecting the width varying portions separated by the perforated hole, at a distal end side in the terminal protruding direction.

3 Claims, 6 Drawing Sheets

BEFORE INSERTION OF SUBSTRATE

BREAKAGE OF DISTAL END PORTION

DURING INSERTION OF SUBSTRATE

COMPLETION OF INSERTION OF SUBSTRATE

PRESS-FIT TERMINAL HAVING A SMALL INSERTION LOAD

INCORPORATION BY REFERENCE

The disclosure of Japanese Patent Application No. 2010-048673 filed on Mar. 5, 2010 including the specification, drawings and abstract is incorporated herein by reference in its entirety.

BACKGROUND OF THE INVENTION

1. Field of the Invention

The invention relates to a press-fit terminal and, more particularly, to a press-fit terminal that can be inserted with a relatively small insertion (press-fitting) load and that can be inserted into a through-hole with high accuracy of position.

2. Description of the Related Art

A press-fit terminal that requires no soldering is proposed as a connecting terminal of a terminal device, which electrically connects various electrical components, a power supply, and the like. For example, Japanese Patent Application Publication No. 2000-294331 (JP-A-2000-294331) describes a press-fit terminal. The press-fit terminal includes: (a) through-hole contact portions that are provided at intermediate portions in a terminal protruding direction, wherein both ends of the through-hole contact portions in a widthwise direction are pressed against an inner peripheral surface of a through-hole of a substrate; (b) distal end side wide portions and proximal end side wide portions that are provided on both sides of the through-hole contact portions in the terminal protruding direction, and that protrude toward both sides in the widthwise direction so as to position the press-fit terminal in a manner such that the substrate is sandwiched between the distal end side wide portions and the proximal end side wide portions on both sides of the substrate in a thickness direction; (c) width varying portions whose width between both ends in the widthwise direction gradually reduces from the distal end side wide portions toward a distal end side in the terminal protruding direction; (d) a longitudinal perforated hole that is provided to extend over the width varying portions, the distal end side wide portions, the through-hole contact portions, and the proximal end side wide portions; and (e) a distal end connecting portion that integrally connects the width varying portions separated by the perforated hole, at a distal end side in the terminal protruding direction, wherein (f) when the press-fit terminal is inserted into the through-hole from a side of the distal end connecting portion, since portions in the width varying portions are engaged with the through-hole, the press-fit terminal is elastically deformed inward in the widthwise direction due to the perforated hole, and when the distal end side wide portions are passed through the through-hole, since the press-fit terminal is elastically returned outward in the widthwise direction, the through-hole contact portions are pressed against the inner peripheral surface of the through-hole to be electrically connected to the inner peripheral surface of the through-hole. In addition, Japanese Patent Application Publication No. 2005-174654 (JP-2005-174654) describes a press-fit terminal. The press-fit terminal has no distal end side wide portion or no proximal end side wide portion, but the press-fit terminal has a perforated hole that is open in a terminal protruding direction.

However, the press-fit terminal described in JP-A-2000-294331 requires a large insertion load when the distal end side wide portions are pushed into the through-hole. Therefore, it is necessary to ensure the strength of the press-fit terminal itself, the through-hole or an insertion device for withstanding the insertion load. This increases the manufacturing cost. On the other hand, the press-fit terminal described in JP-A-2005-174654 easily elastically deforms because the perforated hole is open in the terminal protruding direction. The insertion load may be reduced even when the distal end side wide portions are provided as described in JP-A-2000-294331. However, the distal end of the terminal is open, it is difficult to ensure sufficient accuracy of shape due to deformation or the like caused by residual stress or the like resulting from machining. This easily causes a failure in insertion into the through-hole. Particularly, in the case of a terminal device in which multiple press-fit terminals are arranged in proximity to each other and are inserted into multiple through-holes for connection at the same time, an insertion failure may occur due to a slight shape error.

SUMMARY OF THE INVENTION

The invention is made in light of the above-described circumstances, and it is an object of the invention to allow a press-fit terminal, which can be connected to a substrate without soldering, to be inserted into a through-hole with high accuracy of position, and with a relatively small insertion load.

The object indicated above can be achieved according to a first aspect of the present invention, which provides a press-fit terminal including: (a) through-hole contact portions provided at intermediate portions in a terminal protruding direction, both ends of the through-hole contact portions in a widthwise direction being pressed against an inner peripheral surface of a through-hole of a substrate; (b) distal end side wide portions and proximal end side wide portions provided on both sides of the through-hole contact portions in the terminal protruding direction, and protruding toward both sides in the widthwise direction so as to position the substrate in a manner such that the substrate is sandwiched between the distal end side wide portions and the proximal end side wide portions on both sides of the substrate in a thickness direction; (c) width varying portions whose width between both ends in the widthwise direction gradually reduces from the distal end side wide portions toward a distal end side in the terminal protruding direction; (d) a longitudinal perforated hole provided to extend over the width varying portions, the distal end side wide portions, the through-hole contact portions, and the proximal end side wide portions; (e) a distal end connecting portion integrally connecting the width varying portions separated by the perforated hole, at a distal end side in the terminal protruding direction, (f) wherein when the press-fit terminal is inserted into the through-hole from a side of the distal end connecting portion and portions in the width varying portions are engaged with the through-hole, the press-fit terminal is elastically deformed inward in the widthwise direction due to the perforated hole, and when the distal end side wide portions are passed through the through-hole and the press-fit terminal is elastically returned outward in the widthwise direction, the through-hole contact portions are pressed against the inner peripheral surface of the through-hole to be electrically connected to the inner peripheral surface of the through-hole; and (g) the distal end connecting portion having a fragile breaking portion broken before the distal end side wide portions reach the through-hole when the width varying portions are engaged with the through-hole to be elastically deformed while the width varying portions are passed through the through-hole.

The object indicated above can be achieved according to a second aspect of the present invention, which provides the press-fit terminal according to the first aspect of the present invention, wherein a minimum thickness portion or a minimum width portion is formed at substantially a center of the distal end connecting portion in the widthwise direction to serve as the breaking portion.

The object indicated above can be achieved according to a third aspect of the present invention, which provides the press-fit terminal according to the second aspect of the present invention, wherein the minimum thickness portion or the minimum width portion is formed of a V-shaped notch provided in the distal end connecting portion.

In this way, in the press-fit terminals according to the present embodiment, when each press-fit terminal is inserted into the through-hole from the side of the distal end connecting portion, the width varying portions are engaged with the through-hole to be elastically deformed. This causes the breaking portion provided in the distal end connecting portion to break before the distal end side wide portions reach the through-hole. Thus, the flexibility of deformation or displacement of the broken distal end portion increases. Therefore, the press-fit terminal easily elastically deforms. This reduces an insertion load when the distal end side wide portions having a large width are inserted into the through-hole. Thus, the necessary strength required of the press-fit terminals themselves, the through-holes, or the insertion device is reduced, and therefore, the manufacturing cost is reduced.

In addition, before each press-fit terminal is inserted into the through-hole, the width varying portions separated by the perforated hole are integrally connected to each other by the distal end connecting portion. Therefore, deformation or the like due to residual stress or the like resulting from machining is suppressed to obtain high accuracy of shape, and accuracy of position with respect to the through-hole improves to suppress an insertion failure. Thus, for instance, in the terminal device in which the multiple press-fit terminals are arranged in proximity to each other as well, the multiple press-fit terminals can be appropriately inserted into the multiple through-holes stably at the same time.

In the second aspect of the present invention, a minimum thickness portion or a minimum width portion is formed at substantially a center of the distal end connecting portion in the widthwise direction to serve as the breaking portion. Therefore, stress concentration reliably easily occurs at the breaking portion to easily cause the breaking portion to break. In the third aspect of the present invention, the minimum thickness portion or the minimum width portion is formed of a V-shaped notch provided in the distal end connecting portion. Therefore, it is possible to easily tune the breaking strength by changing the depth d of each notch.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein:

FIG. 1A to FIG. 1D are views that show an example of a terminal device that has multiple press-fit terminals to which the invention is applied, in which FIG. 1A is an overall perspective view, FIG. 1B is a front view of the press-fit terminal, FIG. 1C is a sectional view that shows a state where the press-fit terminal is inserted in and connected to a through-hole of a substrate, and FIG. 1D is an enlarged sectional view taken along the line ID-ID in FIG. 1C;

FIG. 2A to FIG. 2C are enlarged views of the portion II in FIG. 1B, in which FIG. 2A is a plan view as viewed from the upper side of FIG. 2B, FIG. 2B is a front view corresponding to FIG. 1B, and FIG. 2C is a side view as viewed from the right side of FIG. 2B;

DETAILED DESCRIPTION OF EMBODIMENTS

Figure 1A:
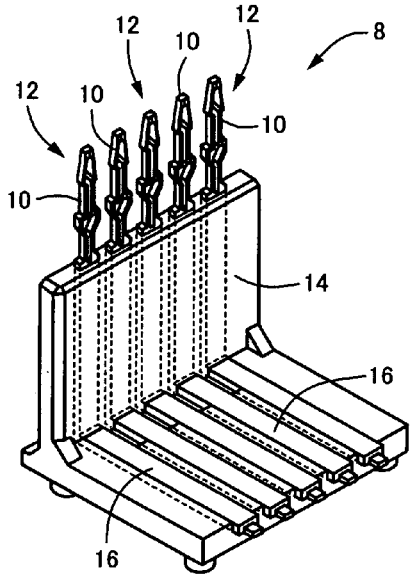

A press-fit terminal according to the invention is preferably applied to, for example, a terminal device in which a plurality of press-fit terminals are arranged in proximity to each other and are inserted into a plurality of through-holes to be connected thereto at the same time, and may also be applied to a single press-fit terminal. The press-fit terminal may be, for example, manufactured through punching by means of pressing or the like, as a main machining process using a conductive metal plate material or the like. Instead, the press-fit terminal may be manufactured through cutting or grinding. When necessary, a conductive coating, such as tin (Sn) plating, may be formed on the surface of the press-fit terminal.

A circular hole is widely employed as a through-hole of a substrate; instead, the through-hole may be a rectangular hole, a square hole, or an elliptical hole other than the circular hole. A conductive film, such as copper (Cu) plating, copper foil and tin (Sn) plating, or a conductive tubular member is provided on the inner peripheral surface of the through-hole. The conductive film or the conductive tubular member is connected to an electrical circuit, such as a printed circuit, provided on the surface of the substrate. Through-hole contact portions of the press-fit terminal are pressed against the inner peripheral surface of the through-hole to be electrically connected to the inner peripheral surface of the through-hole. The through-hole contact portions have portions that are brought into contact with the through-hole at both ends of the through-hole contact portions in the widthwise direction. The portions may be formed in a circular arc shape or the like corresponding to the shape of the inner peripheral surface of the through-hole so as to be brought into surface contact with the inner peripheral surface of the through-hole. Instead, for example, through-hole contact portions having a rectangular cross section may be employed against a circular through-hole and corner portions of the rectangular cross section may be brought into point contact or line contact with the inner peripheral surface of the through-hole. The width between both ends of the through-hole contact portions is, for example, larger than the diameter of a circular through-hole, in a natural state before the press-fit terminal is connected to the through-hole of the substrate. Thus, both ends of the through-hole contact portions are pressed against the inner peripheral surface of the through-hole with the elasticity of the press-fit terminal itself, in a connected state.

A fragile breaking portion is provided in a distal end connecting portion of the press-fit terminal. A portion having a partially reduced cross-sectional area is appropriate as the breaking portion. For example, the breaking portion may be a minimum thickness portion in which a V-shaped notch or V-shaped notches or the like is or are provided at substantially a center of the distal end connecting portion in the widthwise direction at one side or both sides in the thickness direction, a minimum width portion in which a V-shaped notch or the like is provided to extend in a thickness direction of the distal end connecting portion (terminal protruding direction) or a portion provided with a perforated hole that is provided in the distal end connecting portion to extend in the thickness direction or in the widthwise direction of the distal end connecting portion, separately from a longitudinal perforated hole. When width varying portions are engaged with the through-hole to be elastically deformed inward, a compression load is applied to the distal end connecting portion. Therefore, a portion having an easily breakable shape, such as a crank shape, that is sheared by the compression load may be employed as the breaking portion.

When implementing the invention, in order to elastically deform the press-fit terminal, it is preferable that, for example, (a) the shapes of both ends in the widthwise direction of the width varying portions, the distal end side wide portions, the through-hole contact portions, and proximal end side wide portions should be substantially symmetrical with respect to a terminal center line O respectively, and (b) the perforated hole should be substantially symmetrical with respect to the terminal center line O, and the inside width of the perforated hole should vary in accordance with changes of the shapes of both ends in the widthwise direction of the width varying portions, the distal end side wide portions, the through-hole contact portions, and proximal end side wide portions. That is, in addition to the shapes of both ends in the widthwise direction vary, the inside shapes determined on the basis of the shape of the perforated hole vary in accordance with the shapes of both ends in the widthwise direction. However, the shape of the perforated hole is not necessarily varied in accordance with the shapes of both ends in the widthwise direction. For example, the shape of the perforated hole may be a simple slender slit-like hole or the like.

In addition, for example, (a) the press-fit terminal includes paired elastically deformable longitudinal arms that are provided on both sides of the perforated hole substantially symmetrically with respect to the terminal center line O, and the paired arms are connected each other at both longitudinal ends of the perforated hole to provide the distal end connecting portion at a distal end side in the terminal protruding direction, and (b) the paired arms include the width varying portions, the distal end side wide portions, the through-hole contact portions and the proximal end side wide portions. In this case, furthermore, it is preferable that (c) the paired arms should extend in parallel with each other at the through-hole contact portions, (d) the paired arms should be bent outward from the through-hole contact portions so as to be spaced apart from each other at the distal end side wide portions and the proximal end side wide portions, and (e) the paired arms should be inclined or curved so as to approach each other at the width varying portions.

First Embodiment

Hereafter, a first embodiment of the invention will be described in detail with reference to the accompanying drawings. FIG. 1A is a perspective view of a terminal device 8 for a vehicle electrical apparatus that includes multiple (five in this embodiment) press-fit terminals 10 to which the invention is applied. The press-fit terminals 10 are respectively integrally provided at one end portions of longitudinal conductive plates 12 that are bent in an L shape. The conductive plates 12 are integrally fixed to a synthetic resin base 14 so that the conductive plates 12 are arranged side by side so as to be in proximity to each other at constant intervals. The synthetic resin base 14 has an L shape. The synthetic resin base 14 is insert-molded integrally with the multiple conductive plates 12 in a state where corner portions of the multiple conductive plates 12 are buried in the synthetic resin base 14. Portions of the conductive plates 12, which protrude upward from the synthetic resin base 14, serve as the press-fit terminals 10. One surfaces (upper surfaces) of the other end portion sides are exposed from the surface of the synthetic resin base 14. The other end portion sides are used as bonding portions 16 to which predetermined connection terminals are integrally connected by vibration welding or the like.

Figure 1B:
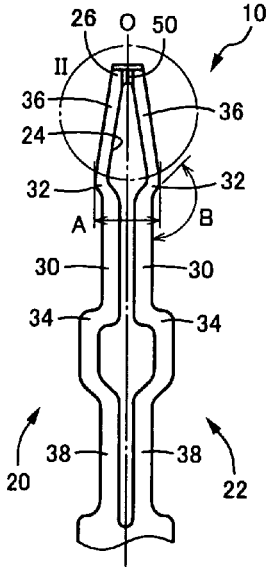

FIG. 1B is an enlarged front view of one of the press-fit terminals 10 that are integrally provided for the conductive plates 12. Each press-fit terminal includes paired elastically deformable longitudinal arms 20 and 22 that are provided symmetrically with respect to the terminal center line O. Both longitudinal ends of the paired arms 20 and 22 are integrally connected to each other to form a perforated hole 24 inside the paired arms 20 and 22. A distal end connecting portion 26 is provided at a distal end side in the terminal protruding direction (upper side in FIG. 1B). The paired arms 20 and 22 include through-hole contact portions 30 provided at intermediate portions in the terminal protruding direction. The through-hole contact portions 30 are substantially parallel to each other. Each of the through-hole contact portions 30 has a substantially constant plate width. Both outer ends of the through-hole contact portions 30 in the widthwise direction that is the right-left direction in FIG. 1B are pressed against the inner peripheral surface of a through-hole 42 of a substrate 40 by the elasticity of the arms 20 and 22 in the connected state shown in FIG. 1C and FIG. 1D.

Figure 1C:
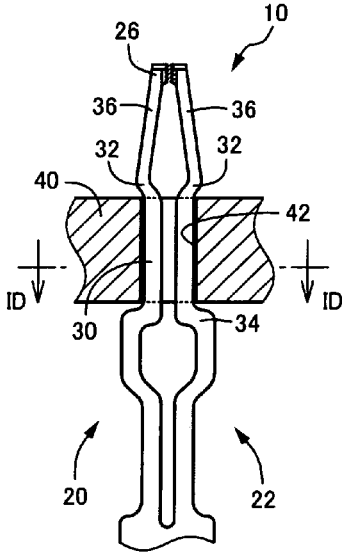
Figure 1D:
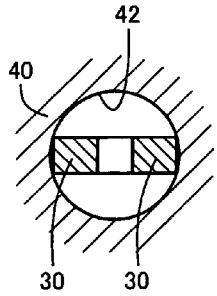

FIG. 1D is an enlarged sectional view taken along the line ID-ID in FIG. 1C. Each of the through-hole contact portions 30 has a rectangular cross section, whereas the through-hole 42 is a circular hole. Edge lines of two outer corner portions of each through-hole contact portion 30 are brought into line contact with the inner peripheral surface of the through-hole 42. Each press-fit terminal 10 is part of the conductive plate 12 and is formed of a conductive metal plate material. When necessary, a conductive film, such as Sn plating, is provided on the conductive metal plate material. In addition, a conductive film, such as Cu plating, copper foil and Sn plating, or a conductive cylindrical member is provided on the inner peripheral surface of the through-hole 42. The conductive film or the conductive cylindrical member is connected to an electrical circuit, such as a printed circuit, provided on the surface of the substrate 40. The through-hole contact portions 30 of each press-fit terminal 10 are pressed against the inner peripheral surface of the through-hole 42 to be electrically connected to the inner peripheral surface of the through-hole 42. The width between both ends of the paired through-hole contact portions 30 in the widthwise direction is set so that the paired through-hole contact portions 30 are pressed against the inner peripheral surface of the through-hole 42 by the elasticity of the paired arms 20 and 22 to be reliably electrically connected to the inner peripheral surface of the through-hole 42. In the present embodiment, the width between both ends of the paired through-hole contact portions 30 in the widthwise direction is larger than the diameter of the through-hole 42 in the state shown in FIG. 1B.

Each of the through-hole contact portions 30 has a length in the terminal protruding direction, which is substantially the same as the thickness of the substrate 40. The paired arms 20 and 22 include distal end side wide portions 32 and proximal end side wide portions 34 at portions located on both sides of the through-hole contact portions 30 in the terminal protruding direction. The distal end side wide portions 32 are bent outward from the through-hole contact portions 30 so as to be spaced apart from each other and protrude toward both sides in the widthwise direction. The proximal end side wide portions 34 are bent outward from the through-hole contact portions 30 so as to be spaced apart from each other and protrude toward both sides in the widthwise direction. Thus, in the connected state shown in FIG. 1C, the substrate 40 is sandwiched between the distal end side wide portions 32 and the proximal end side wide portions 34 on both sides of the substrate 40 in the thickness direction (vertical direction in FIG. 1C), and thus, the substrate 40 is positioned at a certain level (a spaced position). This also appropriately prevents each press-fit terminal 10 from relatively slipping out from the through-hole 42 to cause the substrate 40 to drop off. In order to prevent each press-fit terminal 10 from unintentionally slipping off due to vibrations or the like of a vehicle while permitting insertion and removal of each press-fit terminal 10 into or from the through-hole 42, the appropriate width A between both ends of the distal end side wide portions 32 in the widthwise direction is about 1.05 to 1.30 times the diameter of the through-hole. In the present embodiment, the width A is set to 1.0±0.1 mm against the through-hole diameter of 0.85 mm. In addition, the appropriate inclination angle B of each distal end side wide portion 32 falls within the range of about 120° to 150°. In the present embodiment, the inclination angle B is set to 135±10°. Note that the width A and the inclination angle B vary depending on the thickness t of the press-fit terminal 10 (see FIG. 2A), that is, the thickness of the conductive plate 12. In the present embodiment, the thickness t is 0.4 mm.

The paired arms 20 and 22 include width varying portions 36 each of which has a substantially constant plate width. The width varying portions 36 are inclined so as to approach each other from the distal end side wide portions 32 toward the distal end side in the terminal protruding direction. The width between both ends of the width varying portions 36 in the widthwise direction gradually reduces from the distal end side wide portions 32 toward the distal end side in the terminal protruding direction. Distal end portions of the width varying portions 36 are integrally connected to each other by the distal end connecting portion 26. The width of the distal end connecting portion 26 is set so that the press-fit terminal 10 may be inserted into the through-hole 42 with a predetermined play. When the press-fit terminal 10 is inserted into the through-hole 42 from the side of the distal end connecting portion 26, portions in the width varying portions 36 are engaged with an open end of the through-hole 42, and then the arms 20 and 22 are elastically deformed (flexibly deformed) inward by the inclinations of the width varying portions 36.

Each of the proximal end side wide portions 34 has a predetermined length in the terminal protruding direction. The paired arms 20 and 22 include parallel portions 38 provided on proximal end sides of the proximal end side wide portions 34. Each of the parallel portions 38 has a predetermined length. The parallel portions 38 are parallel to each other. A gap between the parallel portions 38 is substantially the same as a gap between the through-hole contact portions 30. Because of these proximal end side wide portions 34 and parallel portions 38, the allowable amount of elastic deformation of the arms 20 and 22 increases. Therefore, the distal end side wide portions 32 can be inserted into the through-hole 42 by the elastic deformation of the arms 20 and 22, resulting from engagement of the width varying portions 36 with the through-hole 42.

Each press-fit terminal 10 includes the paired arms 20 and 22 that are symmetrical with respect to the terminal center line O. The width between both ends of the paired arms 20 and 22 in the widthwise direction varies in the terminal protruding direction in accordance with the shapes of the width varying portions 36, distal end side wide portions 32, through-hole contact portions 30, proximal end side wide portions 34 and parallel portions 38 of the arms 20 and 22. In the paired arms 20 and 22, the plate width of each width varying portion 36 is smaller than those of the other portions. The shape of each of the paired arms 20 and 22 varies in accordance with a variation in the width between both ends of the paired arms 20 and 22 in the widthwise direction, and the inside width of the perforated hole 24 formed inside these arms 20 and 22 also varies in accordance with a variation in the width between both ends of the paired arms 20 and 22 in the widthwise direction.

Figure 2A:
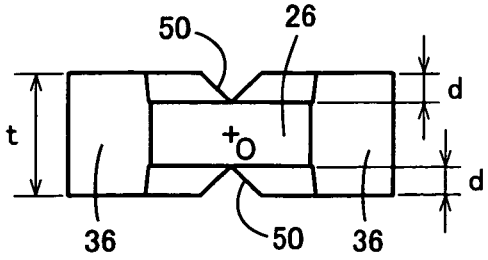
Figure 2B:
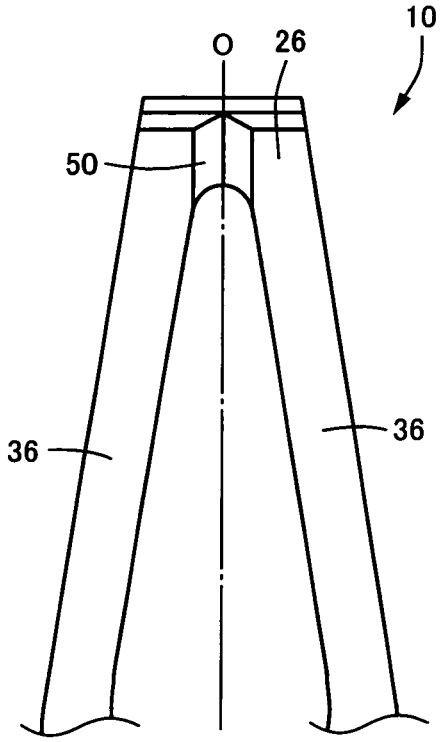
Figure 2C:
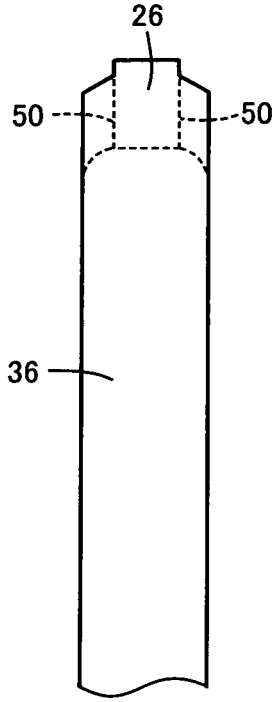
Figure 3:
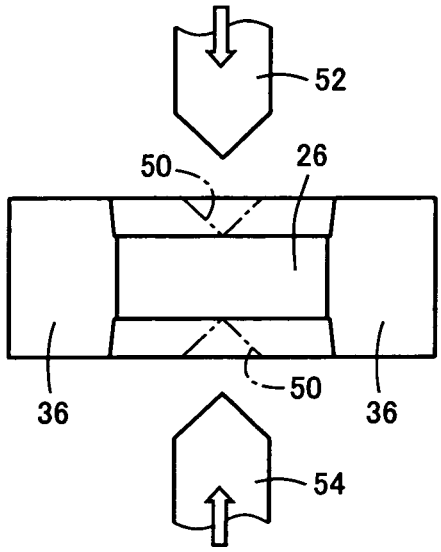
FIG. 3 is a view that illustrates the process of forming notches provided at a distal end connecting portion of the press-fit terminal shown in FIG. 2A to FIG. 2C, by pressing.

On the other hand, a fragile breaking portion is provided in the distal end connecting portion 26. The press-fit terminal 10 is inserted into the through-hole 42 to cause the width varying portions 36 to be engaged with the through-hole 42, and the paired arms 20 and 22 are elastically deformed so as to approach each other. Thus, the breaking portion breaks before the distal end side wide portions 32 reach the through-hole 42. FIG. 2A to FIG. 2C are enlarged views of the portion II shown in FIG. 1B, including the distal end connecting portion 26. FIG. 2B is a front view corresponding to FIG. 1B. FIG. 2A is a plan view as viewed from the upper side of FIG. 2B. FIG. 2C is a side view as viewed from the right side of FIG. 2B. V-shaped notches 50 are provided at the center of the distal end connecting portion 26 in the widthwise direction. The notches 50 are provided at both sides in the thickness direction that is the up and down direction of FIG. 2A. The depths d of the paired notches 50 are equal to each other. In the present embodiment, the depth d is about 0.1 mm, and, as shown in FIG. 3, the paired notches 50 may be formed by pressing paired dies 52 and 54 from both sides. Then, when the notches 50 are provided in this way, the thickness of that portion reduces to locally reduce the cross-sectional area, and stress concentration easily occurs to easily break. Therefore, when the paired arms 20 and 22 are elastically deformed so as to approach each other, a predetermined compression load is applied in the widthwise direction that is the right-left direction in FIG. 2A and FIG. 2B to cause the breaking portion to break. In the present embodiment, a minimum thickness portion having the notches 50 corresponds to the breaking portion, and the breaking strength, that is, the depth d of each notch 50, is set so that the breaking portion breaks before the distal end side wide portions 32 are inserted into the through-hole 42.

Figure 4A:
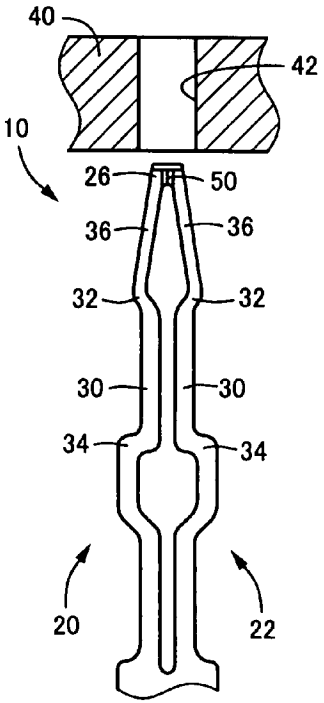
FIG. 4A to FIG. 4D are views that illustrate changes of shape of the press-fit terminal shown in FIG. 1A to FIG. 1D when the press-fit terminal is inserted into the through-hole of the substrate.
Figure 4B:
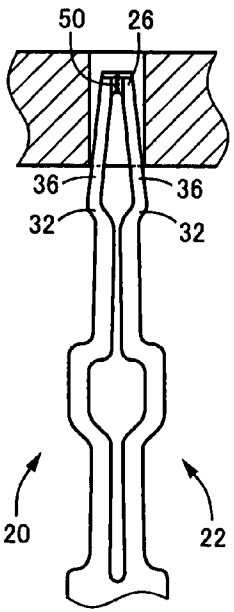

With the above press-fit terminals 10, as shown in FIG. 4A, when each press-fit terminal 10 is relatively inserted into the through-hole 42 of the substrate 40 from the side of the distal end connecting portion 26 using an insertion device (press-fitting device or the like) (not shown), portions in the width varying portions 36 are engaged with the through-hole 42, and the paired arms 20 and 22 are elastically deformed inward due to the perforated hole 24. A compression load is applied to the distal end connecting portion 26 due to the elastic deformation. When the compression load exceeds a predetermined value with the progress of elastic deformation, the breaking portion having the notches 50 breaks as shown in FIG. 4B. Thus, the flexibility of deformation or displacement of the broken distal end portions increases. Therefore, the paired arms 20 and 22 easily elastically deform. That is, the modulus of elasticity reduces to make it possible to insert the press-fit terminal 10 with a small insertion load. Thus, the distal end side wide portions 32 having a large width are easily inserted into the through-hole 42.

Figure 4C:
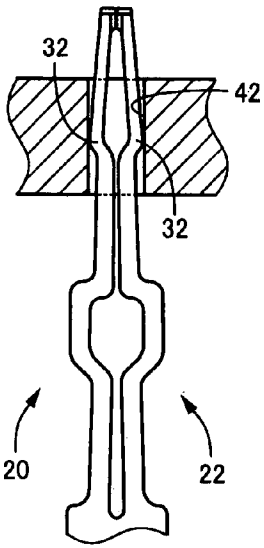
Figure 4D:
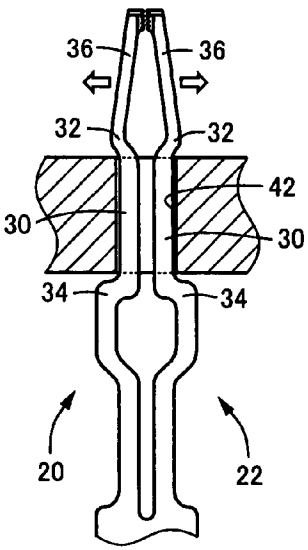

FIG. 4C shows a process in which the distal end side wide portions 32 are inserted into the through-hole 42 and are then passed through the through-hole 42. When the distal end side wide portions 32 are passed through the through-hole 42, the paired arms 20 and 22 are pivoted by their elasticity in directions to be spaced apart from each other as shown in FIG. 4D. Thus, the through-hole contact portions 30 are pressed against the inner peripheral surface of the through-hole 42 by the elasticity of the arms 20 and 22 to be electrically connected to the inner peripheral surface of the through-hole 42, whereas the substrate 40 is positioned between the distal end side wide portions 32 and the proximal end side wide portions 34, and the press-fit terminal 10 is prevented from relatively slipping out from the through-hole 42 to cause the substrate 40 to drop off.

In this way, in the press-fit terminals 10 according to the present embodiment, when each press-fit terminal 10 is inserted into the through-hole 42 from the side of the distal end connecting portion 26, the width varying portions 36 are engaged with the through-hole 42 to be elastically deformed. This causes the breaking portion (a portion having the notches 50) provided in the distal end connecting portion 26 to break before the distal end side wide portions 32 reach the through-hole 42. Thus, the flexibility of deformation or displacement of the broken distal end portion increases. Therefore, the press-fit terminal 10 easily elastically deforms. This reduces an insertion load when the distal end side wide portions 32 having a large width are inserted into the through-hole 42. Thus, the necessary strength required of the press-fit terminals 10 themselves, the through-holes 42, or the insertion device is reduced, and therefore, the manufacturing cost is reduced.

In addition, before each press-fit terminal 10 is inserted into the through-hole 42, the width varying portions 36 separated by the perforated hole 24 are integrally connected to each other by the distal end connecting portion 26. Therefore, deformation or the like due to residual stress or the like resulting from machining is suppressed to obtain high accuracy of shape, and accuracy of position with respect to the through-hole 42 improves to suppress an insertion failure. Thus, in the terminal device 8 in which the multiple press-fit terminals 10 are arranged in proximity to each other as well, the multiple press-fit terminals 10 can be appropriately inserted into the multiple through-holes 42 stably at the same time.

In addition, in the present embodiment, the distal end connecting portion 26 has the V-shaped notches 50 at substantially the center in the widthwise direction, and the minimum thickness portion at which the thickness is locally small is formed as the breaking portion. Therefore, stress concentration reliably easily occurs at the breaking portion (the portion having the notches 50) to easily cause the breaking portion to break, and it is possible to easily tune the breaking strength by changing the depth d of each notch 50.

Figure 5A:
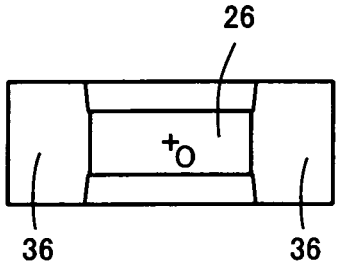
FIG. 5A to FIG. 5C are views that show a second embodiment of the invention, and are three-side-view drawings corresponding to FIG. 2A to FIG. 2C.
Figure 5B:
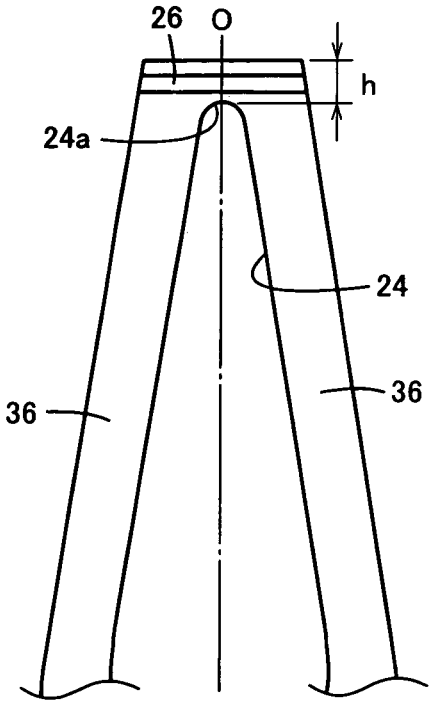
Figure 5C:
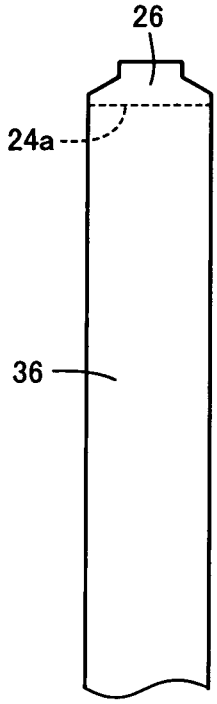

Note that, in the above embodiment, the notches 50 are formed to extend in the thickness direction to provide the breaking portion. Instead, as shown in FIG. 5A to FIG. 5C, a terminal distal end side end portion 24*a* of the perforated hole 24 may be extended to locally reduce the plate width h of the center of the distal end connecting portion 26 in the widthwise direction to cause the center of the distal end connecting portion 26 to easily break. The portion formed by extending the end portion 24*a* corresponds to the minimum width portion. FIG. 5A to FIG. 5C are views corresponding to FIG. 2A to FIG. 2C, and the plate width h is, for example, set to about 0.1 to 0.2 mm.

Figure 6A:
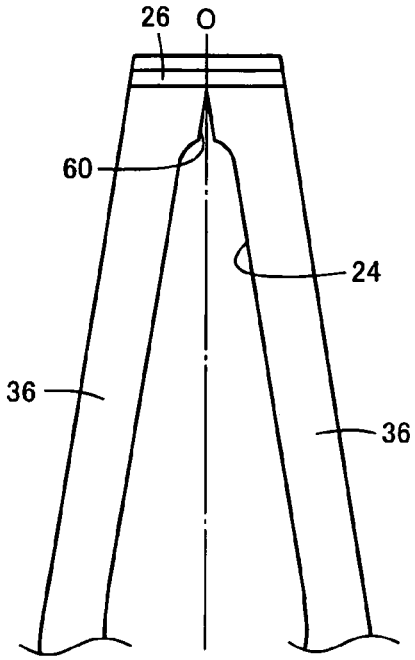
FIG. 6A to FIG. 6D are views that show third to sixth embodiments of the invention, and each of FIG. 6A to FIG. 6D is a front view corresponding to FIG. 5B.
Figure 6B:
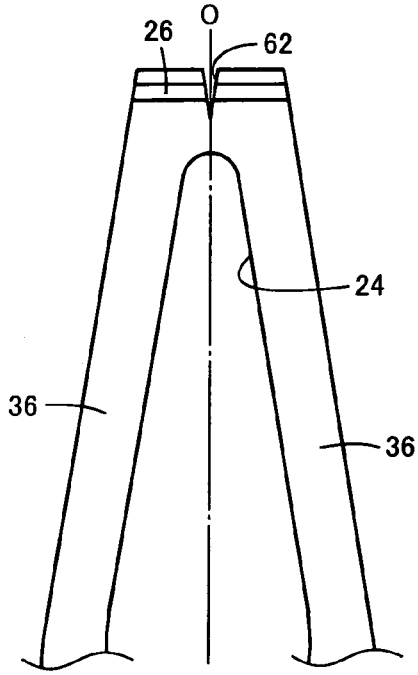
Figure 6C:
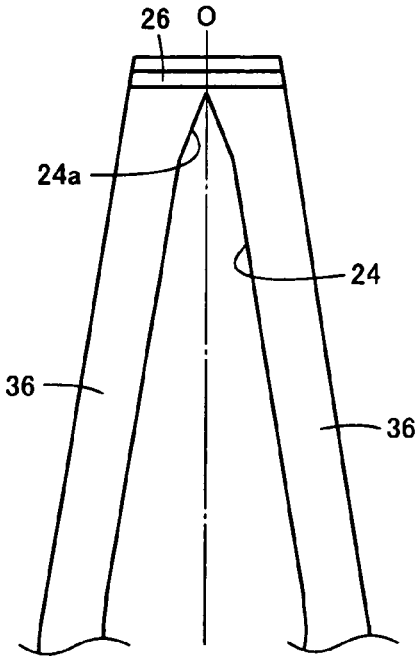

In addition, FIG. 6A to FIG. 6C show third to sixth embodiments in each of which the plate width h of the distal end connecting portion 26 is locally reduced to provide the breaking portion (minimum width portion). FIG. 6A shows the case where the end portion of the perforated hole 24 has a V-shaped notch 60. FIG. 6B shows the case where a V-shaped notch 62 is provided at the distal end of the press-fit terminal 10. In addition, FIG. 6C shows the case where the end portion 24*a* of the perforated hole 24 shown in FIG. 5B is formed in a basic triangular shape. In these cases, stress concentration easily occurs in comparison with the second embodiment shown in FIG. 5A to FIG. 5C, and the breaking portion further easily breaks. The end portion 24*a* in this case may be regarded as a V-shaped notch.

Figure 6D:
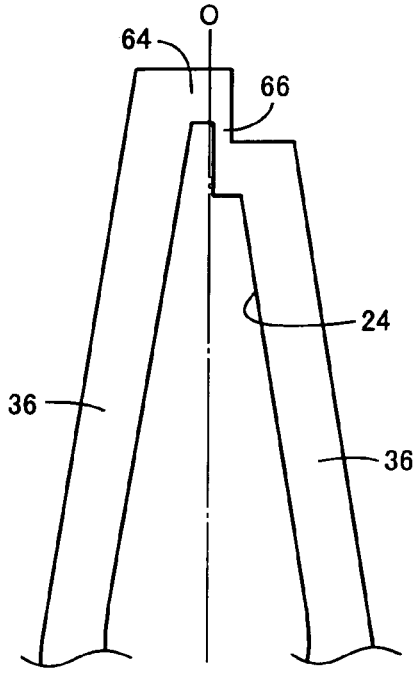

FIG. 6D shows the case where terminal distal end side portions of both width varying portions 36 are connected asymmetrically by a crank-shaped distal end connecting portion 64. When the width varying portions 36 engage with the through-hole 42 to receive a compression load in the right-left direction as shown in FIG. 4B, a shearing load acts on the distal end connecting portion 64 to cause an intermediate portion 66 to break. In this case, the intermediate portion 66 corresponds to the fragile breaking portion (minimum width portion). Note that the breaking portion (minimum thickness portion) may be configured so that, for example, in a state as viewed from the distal end side as shown in FIG. 2A, the positions of the paired notches 50 are offset in the right-left direction from each other and the depth d of each notch 50 is increased to form a crank shape (N shape) and a shearing load acts on the breaking portion to cause the breaking portion to break when the breaking portion receives a compression load in the right-left direction.

Although the embodiments of the invention have been described in detail with reference to the drawings, the embodiments are merely examples, and the invention can be implemented in various forms obtained by altering or modifying the embodiments based on the knowledge of those skilled in the art.

What is claimed is:

1. A press-fit terminal comprising:

through-hole contact portions provided at intermediate portions in a terminal protruding direction, both ends of the through-hole contact portions in a widthwise direction being pressed against an inner peripheral surface of a through-hole of a substrate;

distal end side wide portions and proximal end side wide portions provided on both sides of the through-hole contact portions in the terminal protruding direction, and protruding toward both sides in the widthwise direction so as to position the substrate in a manner such that the substrate is sandwiched between the distal end side wide portions and the proximal end side wide portions on both sides of the substrate in a thickness direction;

width varying portions whose width between both ends in the widthwise direction gradually reduces from the distal end side wide portions toward a distal end side in the terminal protruding direction;

a longitudinal perforated hole provided to extend over the width varying portions, the distal end side wide portions, the through-hole contact portions, and the proximal end side wide portions;

a distal end connecting portion integrally connecting the width varying portions separated by the perforated hole, at a distal end side in the terminal protruding direction, wherein when the press-fit terminal is inserted into the through-hole from a side of the distal end connecting portion and portions in the width varying portions are engaged with the through-hole, the press-fit terminal is elastically deformed inward in the widthwise direction due to the perforated hole, and when the distal end side wide portions are passed through the through-hole and the press-fit terminal is elastically returned outward in the widthwise direction, the through-hole contact portions are pressed against the inner peripheral surface of the through-hole to be electrically connected to the inner peripheral surface of the through-hole; and the distal end connecting portion having a fragile breaking portion broken before the distal end side wide portions reach the through-hole when the width varying portions are engaged with the through-hole to be elastically deformed while the width varying portions are passed through the through-hole.

2. The press-fit terminal according to claim 1, wherein a minimum thickness portion or a minimum width portion is formed at substantially a center of the distal end connecting portion in the widthwise direction to serve as the breaking portion.

3. The press-fit terminal according to claim 2, wherein the minimum thickness portion or the minimum width portion is formed of a V-shaped notch provided in the distal end connecting portion.

* * * * *